US007467962B2

(12) United States Patent
Sunaga

(10) Patent No.: US 7,467,962 B2
(45) Date of Patent: Dec. 23, 2008

(54) ELECTRICAL CONNECTOR FOR FLAT CONDUCTOR

(75) Inventor: Shiro Sunaga, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/979,771

(22) Filed: Nov. 8, 2007

(65) Prior Publication Data

US 2008/0113542 A1 May 15, 2008

(30) Foreign Application Priority Data

Nov. 15, 2006 (JP) ..... 2006-309005

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 7,258,561 B2 * 8/2007 Fukazawa ..... 439/260

2007/0087605 A1 * 4/2007 Suzuki et al. ..... 439/260

FOREIGN PATENT DOCUMENTS

JP 2004-178959 6/2004

OTHER PUBLICATIONS

European Search Report, Feb. 12, 2008.

* cited by examiner

*Primary Examiner*—Truc T Nguyen
(74) *Attorney, Agent, or Firm*—Kubotera & Associates, LLC

(57) ABSTRACT

A connector for a flat conductor includes a terminal maintaining a flat plane shape and having a fixed arm portion and a movable arm portion extending in a same direction. The fixed arm portion and the movable arm portion are connected through a joining portion at an intermediate portion thereof in a longitudinal direction thereof. A housing securely holds the fixed arm portion. The movable arm portion has a press portion on one end thereof in a longitudinal direction thereof and a pressed portion on the other end thereof. A cam portion of a pressure member presses the pressed portion to displace the pressed portion when the pressure member moves in a specific direction. When the pressed portion is displaced within the plane, the movable arm portion is displaced around the joining portion as a lever to displace the press portion, so that the press portion presses the flat conductor.

7 Claims, 3 Drawing Sheets

ELECTRICAL CONNECTOR FOR FLAT CONDUCTOR

BACKGROUND OF THE INVENTION AND RELATED ART STATEMENT

The present invention is related to an electrical connector for a flat conductor.

As an electrical connector for a flat conductor, a connector having a terminal maintaining a flat plane shape of a metal sheet is known. In the connector, a flat conductor is pressed into a contact portion of the terminal by displacing a press portion of the terminal within a flat plane shape thereof.

Patent Reference has disclosed such a connector. In the connector, a terminal connects a fixed arm portion and a movable arm portion at an intermediate portion in approximate parallel to make the arms one member. A movable arm portion situated in an upper side has a press portion to press the flat conductor on one end and a pressed portion to be pressed by a cam portion of a pressure member on the other end. When the cam portion forces the pressed portion to be displaced, the movable arm portion is displaced around the joining portion. Further, the press portion is displaced to press the flat conductor.

Patent Reference: Japanese Patent Publication NO. 2004-178959

In the connector of Patent Reference, two types of the terminals are provided and arranged alternatively. In the both terminals, distances from the joining portions to the pressed portions are the same, while distances from the joining portions to the press portions are different. Accordingly, the press portions of the terminals are situated differently in a longitudinal direction with respect to the movable arm portions and distributed in a zigzag shape to press the flat conductor evenly in a large area.

In the two types of the terminals of the connector according to Patent Reference, distances from the joining portions to the press portions are different, even though distances from the joining portions to the pressed portions are the same. Accordingly, the areas to press the flat conductor are enlarged; however, displacement amounts of the press portions may vary according to positions of the press portions. That is, the suppress force may be varied.

In this type of connector, it is preferred that the connector has a large press area and that the press force is same for all the terminals so as to press the flat conductor evenly.

The present invention is made in consideration of the problems described above. A purpose of the present invention is to provide the electrical connector for the flat conductor having the press portion to press the flat conductor at the same amount of force regardless of the type of the terminals.

SUMMARY OF THE INVENTION

In order to attain the objects described above, according to the present invention, a connector for a flat conductor includes a terminal maintaining a flat plane shape of a metal sheet and having a fixed arm portion and a movable arm portion extending in a same direction. The fixed arm portion and the movable arm portion are connected as one member through a joining portion at an intermediate portion thereof in a longitudinal direction thereof. A housing securely holds the fixed arm portion. The movable arm portion has a press portion on one end thereof in a longitudinal direction thereof and a pressed portion on the other end thereof. A cam portion of a pressure member presses the pressed portion of the movable arm portion to displace the pressed portion within a plane including the plane of the terminal when the pressure member moves in a specific direction. When the pressed portion is displaced within the plane, the movable arm portion is displaced around the joining portion as a lever to displace the press portion, so that the press portion presses the flat conductor.

In the electrical connector for the flat conductor, it is aimed to minimize or eliminate a difference of displacement amounts at the press portions regardless of a type of terminals provided.

According to a first aspect of the present invention, a terminal includes various terminals having press portions situated at different positions in a longitudinal direction of a movable arm portion. In a pressure member, a displacement amount of a cam portion is determined according to the various terminals. Further, the displacement amount at the press portion of the movable arm portion each of the various terminal is minimal amount or the same.

According to a second aspect of the present invention, a terminal includes various terminals having press portions situated at different positions in the longitudinal direction with respect to the movable arm portion. In the terminal, a distance from the pressed portion provided in the movable arm portion to a cam guide portion provided in the fixed arm portion is determined according to the various terminals. Further, the displacement amount at the press portion of the movable arm portion in each of the various terminals is to be minimal or the same.

According to a third aspect of the present invention, a terminal includes various terminals having press portions situated at different positions in a longitudinal direction with respect to the movable arm portion. A ratio of a distance from the joining portion to the press portion and a distance from the joining portion to the pressed portion of the variety of terminals is all set to be substantially the same. Further, the displacement amount at the press portion of the movable arm portion in each of the various terminals is to be minimal or substantially the same.

According to the first to third aspects, the displacement amount of the cam portion and a distance from the pressed portion to the cam portion of the terminal are determined according to the types of the corresponding terminals. Further, a ratio of a distance from the joining portion to the press portion of the movable arm portion and a distance from the joining portion to the pressed portion; that is, an arm length ratio of the movable arm portion changed by a lever, is determined to be the same among a variety of the terminals. Accordingly, the displacement amount at the press portion may be the same or the difference may be limited to minimum in any terminal.

In any of the first to third aspects, it is preferred that in the terminals, one type of the terminals forms the pressed portion in a concave portion, while the other type of the terminals forms the pressed portion on a straight edge.

Each of the terminals may be inserted into the housing according to the type. Accordingly, there may be differences in insert conditions such as an insert pressure and an insert depth according to the type of the terminal. Further, an insert direction may be different. Accordingly, under a variety of insert conditions, even though the pressed portion is formed in a concave portion for the cam portion to easily guide the cam portion, a position of the concave portion may be displaced according to the type of the terminals and may cause a flaw to guide the cam portion.

Accordingly, in the present invention, the pressed portion is formed as a concave portion in one terminal, while the pressed portion is provided on a straight edge in the other terminal. Then, the pressed portion on the straight edge may be guided in any positions even if the displacement of the terminals among the variety of types occurs, thereby dealing with the displacement. A guide at a specific position may be achieved in the concave portion of one terminal.

In the present invention, a variety of the terminals changes the position of the press portion of the terminals to widen a press area against the flat conductor. Further, the displacement amount at the press portion is determined to be the same even if types of the terminals are different. Accordingly, the suppress strength from each terminal within the press area is to be the same to average the press of the flat conductor. As a result, a contact with the flat conductor at the contact portion of each terminal is averaged and to be stable.

BRIEF DESCRIPTION OF THE DRAWINGS

FIGS. 1(A) to 1(D) are sectional views showing an connector according to a first embodiment of the present invention, wherein FIG. 1(A) shows one terminal of the connector when a pressure member is situated at an open position, FIG. 1(B) shows another terminal of the connector when the pressure member is situated at the open position, FIG. 1(C) shows one terminal of the connector when the pressure member is situated at a closed position, and FIG. 1(D) shows another terminal of the connector when the pressure member is situated at the closed position;

FIGS. 2(A) to 2(D) are sectional views showing an connector according to a second embodiment of the present invention, wherein FIG. 2(A) shows one terminal of the connector when a pressure member is situated at an open position, FIG. 2(B) shows another terminal of the connector when the pressure member is situated at the open position, FIG. 2(C) shows one terminal of the connector when the pressure member is situated at a closed position, and FIG. 2(D) shows another terminal of the connector when the pressure member is situated at the closed position; and FIGS. 3(A) to 3(D) are sectional views showing an connector according to a second embodiment of the present invention, wherein FIG. 3(A) shows one terminal of the connector when a pressure member is situated at an open position, FIG. 3(B) shows another terminal of the connector when the pressure member is situated at the open position, FIG. 3(C) shows one terminal of the connector when the pressure member is situated at a closed position, and FIG. 3(D) shows another terminal of the connector when the pressure member is situated at the closed position.

DETAILED DESCRIPTION OF THE PREFERRED EMBODIMENTS

Figure 1:
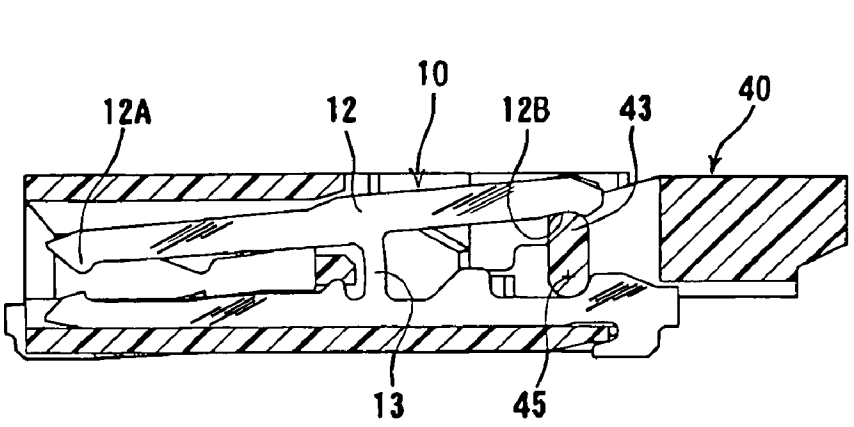
Figure 1:
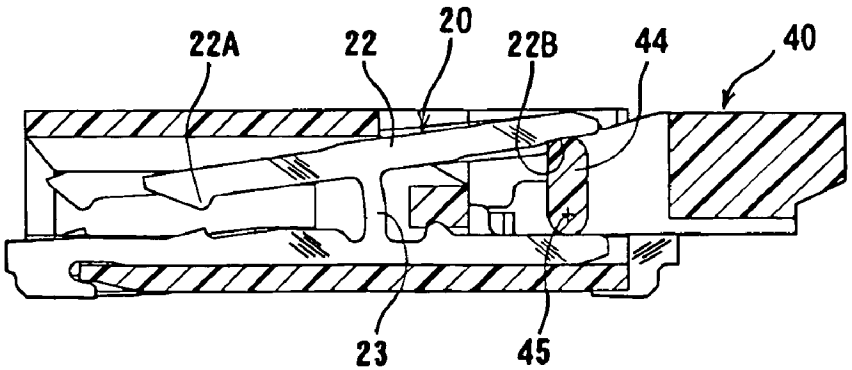
Figure 1:
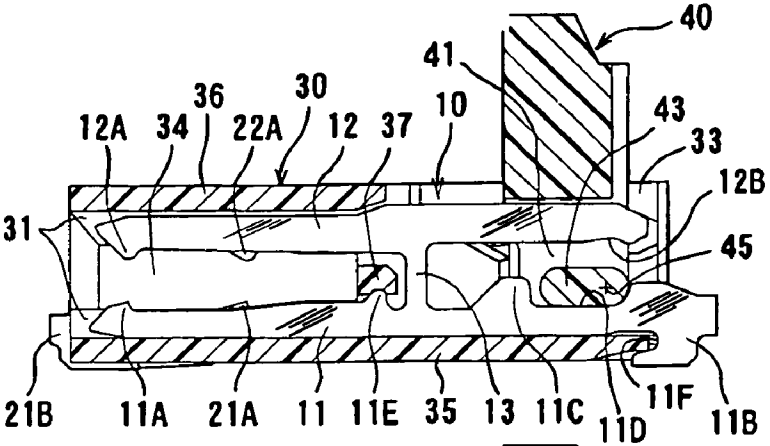
Figure 1:
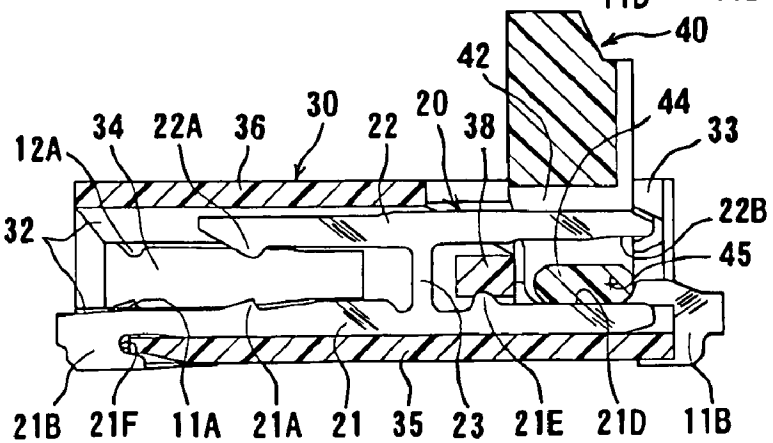
Figure 2:
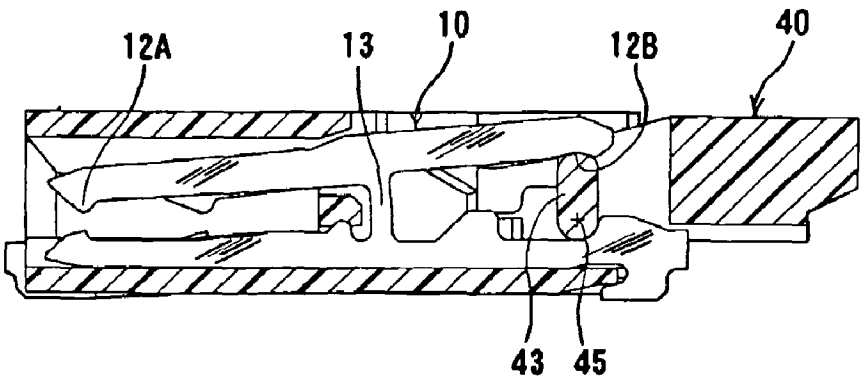
Figure 2:
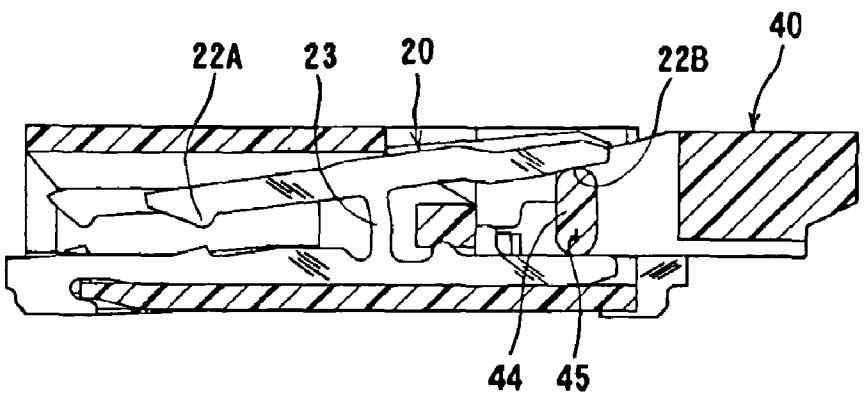
Figure 2:
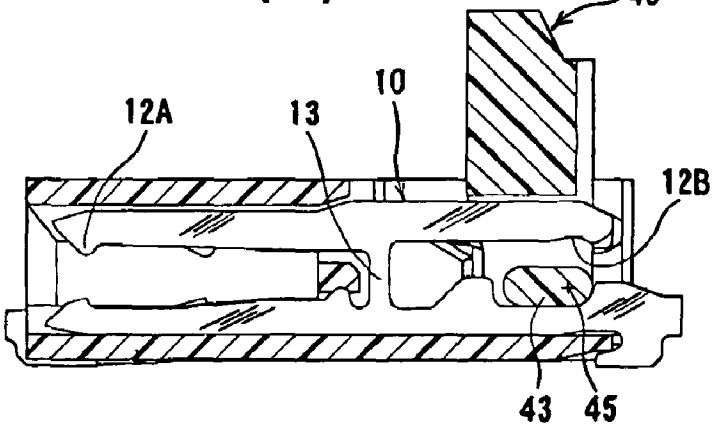
Figure 2:
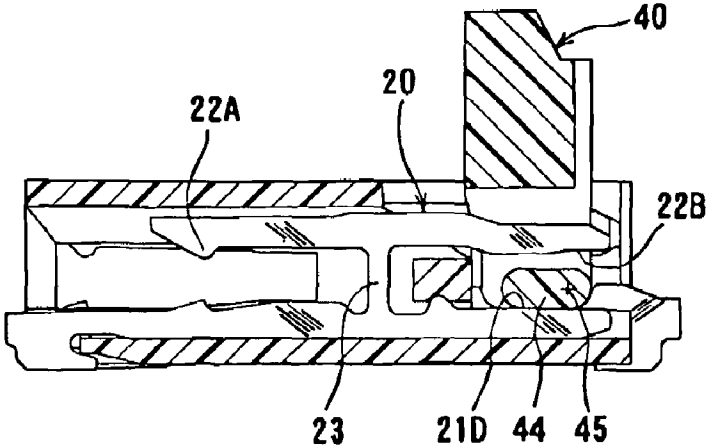
Figure 3:
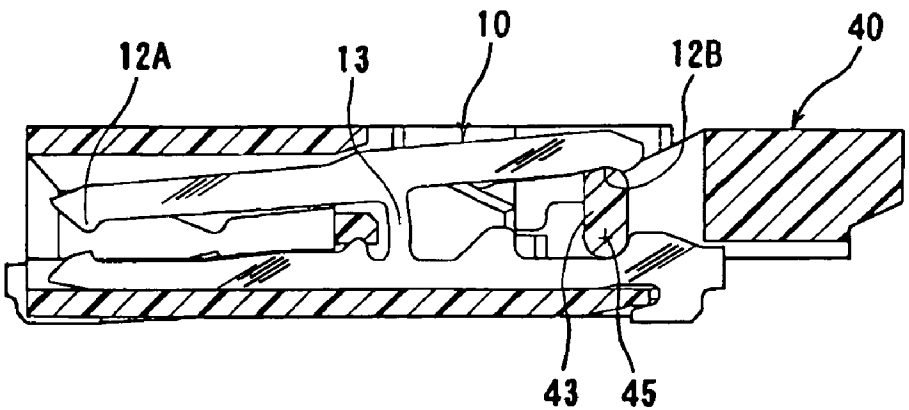
Figure 3:
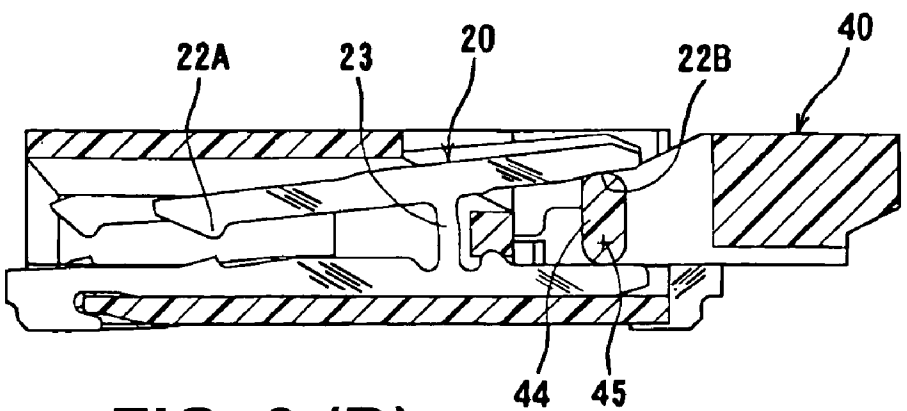
Figure 3:
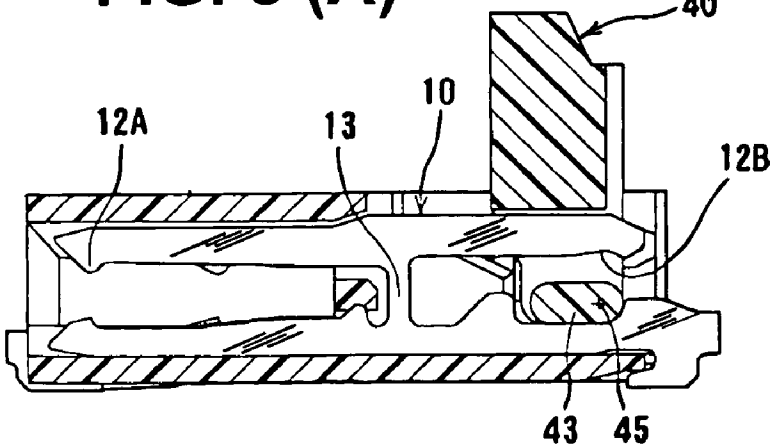
Figure 3:
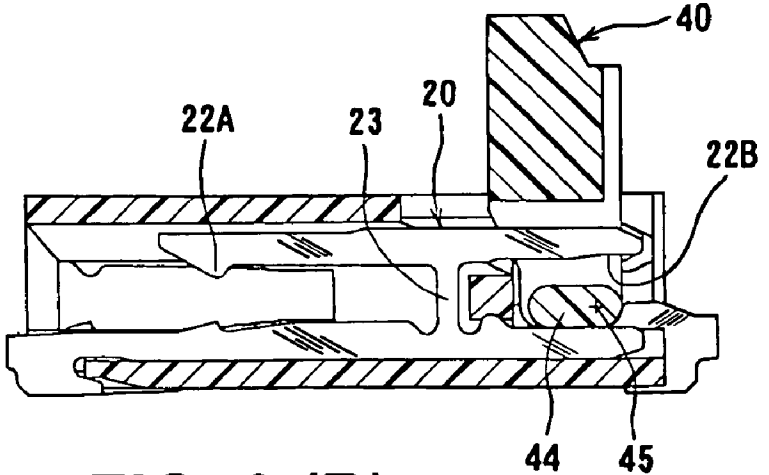

Hereunder, embodiments of the present invention will be explained with reference to the accompanying FIGS. 1(A)-1(D) to 3(A)-3(D).

First Embodiment

As shown in FIGS. 1(A)-1(D), in a connector, a plurality of terminals is arranged in a direction perpendicular to a sheet surface at specific intervals. Each terminal is made of a metal sheet and has a plane parallel to the sheet surface. Two types of the terminals, terminals 10 and 20, are arranged alternatively.

Sectional views of the terminals 10 and 20 are shown in FIG. 1(A) and FIG. 1(B), respectively. FIG. 1(A) and FIG. 1(B) are sectional views of the connectors in which pressure members to be described later are at an open position. On the other hand, FIG. 1(C) and FIG. 1(D) are sectional views of the connectors in which the pressure members are at a close position. FIG. 1(C) shows one terminal, while FIG. 1(D) shows the other terminal. Sectional views of one terminal and the other terminal are shown in FIGS. 1(C) and 1(D), respectively.

Housing 30 having a rectangular section extends in a perpendicular direction with respect to a sheet surface. The housing 30 is formed of an insulative member and is provided with container grooves 31 and 32 to accommodate the terminals 10 and 20, respectively. The container grooves 31 and 32 have an inner width commensurate with a plate thickness of the terminals 10 and 20 (an inner width in a perpendicular direction with respect to the sheet surface) and are in a slit shape extending parallel to the sheet surface.

Further, in FIG. 1(A) and FIG. 1(B), the container grooves 31 and 32 are formed in the housing 30 passing through right to left. In a right half portion of the housing 30, all the container grooves 31 and 32 are communicated in an area covering an intermediate portion with respect to a vertical direction to an upper portion, and a pressure member rotation space 33 that is open to an upper direction is formed. On the other hand, in a left half portion of the housing 30, all the container grooves 31 and 32 are communicated in the intermediate portion with respect to the vertical direction, and a flat conductor insert space 34 that is open to a left side is formed. Accordingly, in the housing 30, the container grooves 31 and 32 are formed in a housing lower wall 35 and in a portion along an inside of an upper wall 36 situated in the left half portion.

Further, the housing 30 has fixed portions 37 and 38 having an island shape. The fixed portions 37 and 38 are situated inside of the container grooves 31 and 32 of the housing 30 and connects inner walls of the container grooves 31 and 32 (inner wall surfaces facing each other in a perpendicular direction with respect to the sheet surface).

The fixed portions 37 and 38 are situated in an intermediate portion with respect to a horizontal direction as shown in FIG. 1(A). On the other hand, the fixed portion 38 inside of the container groove 32 is situated in a right side with respect to the fixed portion 37 inside of the container groove 31 as shown in FIG. 1(B).

The terminals 10 and 20 are formed to maintain the flat plane of the metal sheet as described above. Accordingly, as shown, the terminals 10 and 20 are in an H shape making a 90-degree turn. The terminals 10 and 20 comprise fixed arm portions 11 and 21 and movable arm portions 12 and 22. The fixed arm portions 11 and 21 are situated in a bottom portion of the terminals 10 and 20.

The movable arm portions 12 and 22 are situated above and substantially parallel to the fixed arm portions 11 and 21. Further, connection portions 13 and 23 connect the fixed arm portions 11 and 21 and the movable arm portions 12 and 22 in an intermediate portion of a longitudinal direction thereof so as to form each of the fixed arm portions 11 and 21 and the movable arm portions 12 and 22 to be a member of the connector.

The terminal 10 has a contact portion 11A and a connection portion 11B. The contact portion 11A is a protrusion facing the movable arm portion 12 on a left edge of the fixed arm portion 11 extending near a left edge of the housing 30. The connection portion 11B is provided in a right edge protruding outside of the housing 30. Further, the terminal 10 includes a protrusion portion 11C, a cam guide portion 11D, and an engagement protrusion 11E. The protrusion portion 11C is provided on a right side of the joining portion 13. The cam guide portion 11D is formed in a groove shape between the protrusion portion 11C and the connection portion 11B.

The engagement protrusion 11E is provided on a left side of the joining portion 13. The cam guide portion 11D has a straight groove bottom portion and rounded portions on both ends thereof. Further, the connection portion 11B is formed of a portion protruding outside of the housing 30 and extending downwardly. A fixed groove 11F fitted into a right edge portion of the lower wall 35 of the housing is also formed.

The movable arm portion 12 of the terminal 10 is connected with the fixed arm portion 11 through the joining portion 13 and extends to a right and left with respect to the joining portion 13. A left edge of the movable arm portion 12 is situated to correspond with the contact portion 11A of the fixed arm portion 11. Further, a press portion 12A protruding to face with the contact portion 11A is provided on the left edge. An edge facing the cam guide portion 11D of the fixed arm portion 11 is provided to form a rounded concave portion near a right edge of the movable arm portion 12. The concave portion forms a pressed portion 12B. The pressed portion 12B is situated to correspond with a right portion having a round shape of the cam guide portion 11D of the fixed arm portion 11 in a longitudinal direction with respect to the movable arm portion 12 and the fixed arm portion 11, respectively.

The terminal 10 is inserted into the container groove 31 of the housing 30 from a right edge side thereof. The fixed arm portion 11 is accommodated to the container groove 31 on the lower wall 35 side of the housing 30, and the movable arm portion 12 is accommodated to the container groove 31 on the upper wall 36 side of the housing 30. The fixed arm portion 11 is adjacent to a lower edge of the container groove 31. The engagement protrusion 11E of the fixed arm portion 11 is buried in the fixed portion 37 of the housing 30. A reaction force from the fixed portion 37 presses the lower edge of the fixed arm portion 11 hard to fix to an upper surface of the lower wall 35 of the housing 30.

Further, the fixed groove 11F formed in the connection portion 11B fits into a right edge portion of the lower wall 35 of the housing to fix the fixed arm portion 11 securely. On the other hand, in the movable arm portion 12, a gap is formed between an upper edge of the movable arm portion 12 and a lower surface of the upper wall 36 of the housing 30. The movable arm portion 12 may be elastically deformed in a vertical direction in a groove width direction with respect to an inner wall surface of the container groove 31 while supported in a plate thickness direction with respect to the movable arm portion 12. The movable arm portion 12 is extended to the pressure member rotation space. The pressure member rotation space is situated on a right side of the joining portion 13 and is not covered by the upper wall 36 of the housing 30.

On the other hand, a part of the terminal 20 in which the fixed arm portion 21 extends to a left side of the joining portion 23 protrudes outside of the housing 30. The terminal 20 has a connection portion 21B on a left edge of the housing and a contact portion 21A between the connection portion 21B and the joining portion 23. A shape of the connection portion 21B is similar to a symmetric shape of the connection portion 11B of the terminal 10. Further, the connection portion 21B is provided with a fixed groove 21F fitted into a left edge portion of the lower wall 35 of the housing 30.

The contact portion 21A is situated on the right side of the contact portion 11A of the terminal 10. The fixed arm portion 21 has an engagement protrusion 21E on a right side of the joining portion 23 and a cam guide portion 21D. The cam guide portion 21D guides and supports the cam portion of a pressure member. Further, the cam guide portion 21D is provided on a straight line parallel to the movable arm portion 22 covering a right side of the engagement protrusion 21E to a free edge.

The movable arm portion 22 of the terminal 20 is connected with the fixed arm portion 21 through the joining portion 23 and extends to a right and left with respect to the joining portion 23. The movable arm portion 22 of the terminal 20 extends shorter on a left side of the joining portion 23 than the movable arm portion 12 of the terminal 10. Further, the movable arm portion 22 has a press portion 22A protruding with respect to the contact portion 21A of the fixed arm portion 21 on a left edge thereof. On a left side of the joining portion 23, a gap is created between the movable arm portion 22 and a bottom surface of the upper wall 36 of the housing. Further, on a right side of the joining portion 23, the movable arm portion 22 is provided with the pressed portion 22B in a right edge portion that has a straight line portion parallel to a right side of the cam guide portion 21D of the fixed arm portion 21.

A shape of the terminal 20 is an H shape making a 90-degree turn and is similar to that of the terminal 10. However, there are differences between the terminals 20 and 10. First, the terminal 20 is inserted into the housing 30 from a left side and the engagement protrusion portion 21E is situated on a right side of the joining portion 23. Second, the contact portion 21A of the fixed arm portion 21 and the press portion 22A of the movable arm portion 22 are situated near the joining portion 23. Further, the cam guide portion 21D of the fixed arm portion 21 and the pressed portion 22B of the movable arm portion 22 are provided in a straight edge portion.

The pressure member 40 is made of an insulative material such as a resin. The pressure member 40 is provided to extend outwardly from the housing in FIG. 1 and has a width to cover an arrangement range of the terminals 10 and 20 in a direction perpendicular to a sheet surface; that is, in an arrangement direction with respect to the terminals. Further, the pressure member 40 has grooves 41 and 42 having a slit shape parallel to the sheet surface to allow the movable arm portions 12 and 22 of the terminals 10 and 20 to pass through.

The grooves 41 and 42 are situated in an approximate middle of the inside of the housing 30 in the arrangement direction with respect to the terminals and are formed in a position corresponding to the terminals 10 and 20. The grooves 41 and 42 have cam portions 43 and 44 situated in an end of the pressure member 40 and connects facing inner wall surfaces (inner wall surfaces facing each other in the arrangement direction) of the grooves 41 and 42.

When the pressure member 40 is at an open position as shown in FIGS. 1(A) and 1(B) in which sections of the cam portions 43 and 44 have a horizontally long oval shape, a distance from a right end to a left end of the cam portions 43 and 44 is longer than a distance from the cam guide portions 11D and 21D to the pressed portion 12B and 22B. Further, the cam portion 44 provided with the terminal 20 is made longer than the cam portion 43 provided with the terminal 10. The cam portions 43 and 44 have a common rotation shaft line extending in a direction perpendicular to a sheet surface with respect to a center 45 of a right side semicircular portion shown in FIGS. 1(A) and 1(B).

A distance from the center 45 to a left edge of the cam portion 44 is longer than a distance from the center 45 to a left edge of the cam portion 43. That is, a displacement amount of the cam portion 44 of the terminal 20 is larger than that of the cam portion 43 of the terminal 10. The displacement amount of the cam portion 44 of the terminal 20 and that of the cam portion 43 of the terminal 10 are made to be different. This is because a distance from the joining portion 23 to the press portion 22A of the terminal 20 is shorter than a distance from the joining portion 13 to the press portion 12A of the terminal 10 even though a distance from the joining portion 13 to the pressed portion 12B of the terminal 10 and a distance from the joining portion 23 to the pressed portion 22B of the terminal 20 are the same.

The pressed portions 12B and 22B of the terminals 10 and 20 are pressured from the cam portions 43 and 44 through a rotation operation of the pressure member 40 to rotate to the close position shown in FIGS. 1(B1) and (B2) to elastically displace upwardly according to the displacement amount of the cam. The elastic displacement of the pressed portions 12B and 22B causes a displacement of the movable arm portions 12 and 22 leaning as a lever around the joining portions 13 and 23 to elastically displace the press portions 12A and 22A downwardly.

In a case that the displacement amounts of the cam of the terminals 10 and 20 are the same, the displacement amount of the press portion 22A may be smaller than that of the press portion 12A. However, in the present invention, the displacement amount of the cam of the terminal 20 is set to be larger than that of the terminal 10. Accordingly, the displacement amount of the press portion 22A may be close to that of the press portion 12A. Further, the displacement amounts of the press portions 12A and 22A may be the same by selecting the displacement amount of the cam described above.

The connector of the configuration described above according to the embodiment may be used as described below.

(1) First, as shown in FIGS. 1(A) and 1(B), the pressure member 40 may be at an open position to stand up. Further, a connection circuit portion is inserted into the flat conductor insert space 34 provided in a left portion inside of the housing 30. The connection circuit portion is an edge portion of the flat conductor (not shown). Further, a surface of the connection circuit portion is to be positioned on a lower surface side so as to face the contact portions 11A and 21A of the terminals 10 and 20.

(2) First, the flat conductor is inserted into a specific depth until a distal of the flat conductor is adjacent to an adjacent portion of the housing. Then, the pressure member 40 is rotated in a counterclockwise to be in a close position as shown in FIGS. 1(C) and 1(D). When the pressure member 40 is at a close position, the cam portions 43 and 44 rotate around the center 45 to be in a vertically long position.

The cam portions 43 and 44 press the pressed portions 12B and 22B of the terminals 10 and 20 to displace upwardly. At this time, the displacement amount of the cam portion 44 is larger than that of the cam portion 43. Accordingly, the pressed portion 22B of the terminal 20 is elastically displaced more upwardly than the pressed portion 12B of the terminal 10.

(3) The pressed portions 12B and 22B of the terminals 10 and 20 are displaced so that the movable arm portions 12 and 22 of the terminals 10 and 20 lean as a lever around the joining portions 13 and 23. Accordingly, the press portions 12A and 22A are elastically displaced downwardly. At this time, a distance from the joining portion 23 to the press portion 22A in the terminal 20 is shorter than a distance from the joining portion 13 to the press portion 12A in the terminal 10.

However, the pressed portion 22B is more displaced than the pressed portion 12B. Accordingly, the displacement amounts of the press portions 12A and 22A are substantially the same or the same. Therefore, the press portions 12A and 22A of the terminals 10 and 20 are distributed in a zigzag shape with respect to the flat conductor and the suppress strength of the press portions 12A and 22A are substantially equal.

Accordingly, in the embodiment shown in FIGS. 1(A)-1(D), the displacement amounts in the cam portions of the pressure members are set to correspond with the both types of the terminals so as to make the displacement amounts at the press portions of the both types of the terminals the same or substantially the same. However, the displacement amounts may be adjusted by the terminals through a configuration of the terminals themselves instead of using the pressure members.

Second Embodiment

In FIGS. 2(A) to 2(D), the terminals 10 and 20 are identical with the terminals in FIGS. 1(A) to 1(D) except for the pressed portions 12B and 22B thereof. Further, the cam portions 43 and 44 of the terminals 10 and 20 of the pressure member 40 are formed to be identical.

In an embodiment shown in FIGS. 2(A) to 2(D), the cam portions 43 and 44 of the terminals 10 and 20 have the same shape and size and a rotation center in the same position. However, the pressed portion 22B of the terminal 20 is positioned closer to the cam guide portion 21D than the pressed portion 12B of the terminal 10 (shown in FIGS. 2(A) and 2(B)).

Accordingly, even though the displacement amounts of the cam portions 43 and 44 through a rotation of the pressure member 40 to the close position are the same, the pressed portion 22B of the terminal 20 is displaced more upwardly than the pressed portion 12B of the terminal 10. As a result, the displacement amount of the press portion 22A of the terminal 20 in which a distance from the joining portion 23 to the press portion 22A is short may be substantially the same or the same as the displacement amount of the press portion 12A of the terminal 10 (shown in FIGS. 2(C) and 2(D)).

Third Embodiment

In an embodiment shown in FIGS. 3(A) to 3(D), a position of the joining portion of the terminal is to be determined so as to make the displacement amount of the press portions of the terminals the same or close to the same. In FIGS. 3(A) to 3(D), the terminals 10 and 20 are identical except for that the joining portions 13 and 23 of the terminals 10 and 20 are different from that of FIG. 1.

In the embodiment in FIGS. 3(A) to 3(D), the joining portion 23 of the terminal 20 is situated more right side of the joining portion 13 of the terminal 10. Accordingly, a ratio of a distance from the joining portion 23 to the press portion 22A and a distance from the joining portion 23 to the pressed portion 22B in the terminal 20 is the same or substantially the same as a ratio of a distance form the joining portion 13 to the press portion 12A and a distance from the joining portion 13 and the pressed portion 12B in the terminal 10. When the ratio described above is the same in the terminals 10 and 20, the press portions are displaced according to the ratio. Accordingly, the displacement amounts at the press portions 12A and 22A of the terminals 10 and 20 are to be the same.

The present invention is not limited to the embodiments described above. Various changes may be made to the present invention. For example, more than two kinds of the terminals may be provided. Further, the displacement amount at the cam portions of the pressure members and positions of the pressed portions and the joining portions of the terminals may be determined or combined according to types of the terminals so that the types of the terminals do not affect or do not substantially affect the displacement amounts of the pressed portions.

Further, in the embodiments shown, a variety of the terminals had the contact portion with the flat conductor on the fixed arm portion side. However, the contact portion on the fixed arm portion side may be used as a receiving portion for the flat conductor and the press portion on the movable arm portion side may function as the contact portion. Further, the contact portion and the fixed arm portion may function as a contact portion. It depends on which surface(s) the connection circuit portion of the flat conductor may be formed on. The present invention may be applicable to the above both cases.

Further, the present invention may be applicable when the pressure member is not rotatable but is a slider to be inserted into the housing.

The disclosure of Japanese Patent Application No. 2006-309005, filed on Nov. 15, 2006, is incorporated in the application by reference.

While the invention has been explained with reference to the specific embodiments of the invention, the explanation is illustrative and the invention is limited only by the appended claims.

What is claimed is:

1. A connector for a flat conductor, comprising:

a housing;

a first terminal disposed in the housing, said first terminal having a first fixed arm portion, a first movable arm portion, and a first joining portion connecting the first fixed arm portion and the first movable portion, said first movable arm portion having a first press portion and a first pressed portion, said first press portion being situated away from the first joining portion by a first distance;

a second terminal disposed in the housing adjacent to the first terminal, said second terminal having a second fixed arm portion, a second movable arm portion, and a second joining portion connecting the second fixed arm portion and the second movable portion, said second movable arm portion having a second press portion and a second pressed portion, said second press portion being situated away from the second joining portion by a second distance different from the first distance; and a pressure member having a first cam portion and a second cam portion for pressing the first press portion and the second press portion, respectively, so that the first press portion and the second press portion displace for a substantially same distance when the pressure member is operated, said first cam portion having a first size and said second cam portion having a second size different from the first size.

2. The connector for a flat conductor according to claim 1, wherein said first fixed arm portion includes a first cam guide portion and said second fixed arm portion includes a second cam guide portion, said first cam portion being situated away from the first pressed portion by a third distance, said second cam portion being situated away from the second pressed portion by a fourth distance different from the third distance.

3. The connector for a flat conductor according to claim 1, wherein said first pressed portion is situated away from the first joining portion by a fifth distance and said second pressed portion is situated away from the second joining portion by a sixth distance so that a ratio of the first distance to the fifth distance is substantially same as that of the second distance to the sixth distance.

4. The connector for a flat conductor according to claim 1, wherein at least one of said first pressed portion and said pressed portion is formed of a concave portion, the other of the first pressed portion and the pressed portion being formed of a straight edge portion.

5. The connector for a flat conductor according to claim 1, wherein said first cam has a rotational axis same as that of the second cam.

6. The connector for a flat conductor according to claim 1, wherein said first cam has a first section having a first shape, said first shape having a first length and a second length perpendicular to the first length and smaller than the first length.

7. The connector for a flat conductor according to claim 6, wherein said second cam has a second section having a second shape, said second shape having a third length and a fourth length perpendicular to the third length and smaller than the third length, said third length smaller than the first length.

* * * * *